US006217188B1

(12) United States Patent
Wainwright et al.

(10) Patent No.: US 6,217,188 B1
(45) Date of Patent: Apr. 17, 2001

(54) COLOR CHANGEABLE FIBER-OPTIC ILLUMINATED DISPLAY

(75) Inventors: Harry Lee Wainwright, Bethlehem; David W. Karr, Center Valley; Stanley A. Bochenski, Jr., Bethlehem, all of PA (US)

(73) Assignee: ANI-Motion, Inc., Bethlehem, PA (US)

( * ) Notice: Subject to any disclaimer, the term of this patent is extended or adjusted under 35 U.S.C. 154(b) by 0 days.

(21) Appl. No.: 09/262,224

(22) Filed: Mar. 4, 1999

(51) Int. Cl.[7] ..... F21V 21/08

(52) U.S. Cl. ..... 362/103; 362/555; 362/570

(58) Field of Search ..... 362/554, 555, 362/559, 570, 565, 552; 340/815.45, 815.42, 815.43

(56) References Cited

U.S. PATENT DOCUMENTS

| | | | | |
|---|---|---|---|---|
| 4,234,907 | * | 11/1980 | Daniel | 362/556 |
| 4,875,144 | * | 10/1989 | Wainwright | 362/103 |
| 5,424,922 | * | 6/1995 | Wise | 362/554 |
| 5,921,674 | * | 7/1999 | Koczi | 362/800 |
| 6,005,692 | * | 12/1999 | Stahl | 359/15 |

* cited by examiner

*Primary Examiner*—Sandra O'Shea
*Assistant Examiner*—Hargobind S. Sawhney
(74) *Attorney, Agent, or Firm*—Sanford J. Piltch

(57) ABSTRACT

An illuminated display makes use of optical fibers and a programmable controller for varying the brightness intensities and colors emitted by color changeable LEDs through the optical fibers. The illuminated fiber optic display is carried on a planar surface and may be incorporated on an article of clothing. By using color-variable LEDs suitably connected to corresponding fiber optic bundles, eye-catching, color-changing displays can be created with fewer interconnections, fewer light sources, and fewer optical fibers.

12 Claims, 7 Drawing Sheets

COLOR CHANGEABLE FIBER-OPTIC ILLUMINATED DISPLAY

FIELD OF THE INVENTION

This invention relates to an illuminated display formed from optical fibers and, more particularly, to an illuminated display which changes color while utilizing the same illumination source and the same optical fibers.

BACKGROUND

It is known to secure optical fibers to fabrics (and other panels) in such a way that the distal ends of the optical fibers are arranged in an illuminated display or pattern. Examples of such illuminated displays and the systems associated with their illumination are disclosed in U.S. Pat. No. 4,875,144 [Wainwright] and PCT Pub. No. WO96/37871, both having inventorship in common with the present application.

One of the motivations to create a fiber-optic illuminated display and secure it to a suitable flexible or semi-rigid material is to catch people's attention. One technique for enhancing the attention-getting characteristics of such displays is to cause different subsets of the optical fibers to be illuminated at different times, as taught by the above-referenced patent documents. Such sequencing can cause the image to appear to "bloom," "blink," or be part of an animated sequence. It is nonetheless desirable to further enhance the attention-getting characteristics of such fiber-optic illuminated displays.

Unfortunately, it is often difficult to enhance the appeal of the fiber-optics display without correspondingly increasing the complexity of the display and thereby increasing its manufacturing costs and its cost for users to acquire. More interesting, eye-catching optical fiber displays may also be unwieldy to carry or, in the case of a clothing item, unwieldy to put on, take off, or wear. For example, current techniques of changing the displayed color at a given point in a fiber-optic display generally require using multiple optical fiber bundles having separate strands terminating at each point at which a changed color is desired coupled with an illumination source of the desired color(s). Thus, to have multiple points on a display change color, each point must have as many optical fibers and color sources as the number of desired colors to be associated therewith; the cumulative effect of which is to significantly increase the required number of optical fibers and colored illumination sources.

Furthermore, the more complex the design, the more likely the display may become damaged due to wear and tear on the flexible material carrying such fiber-optic illuminated display and potential failure of the colored illumination devices. There is, thus, a need to enhance the visual interest or attention-getting characteristics of illuminated displays created from optical fibers. There is also a corresponding need for enhancements to such displays to be accomplished cost effectively. There is a still further need for attention-getting displays created from optical fibers to reduce the number of optical fibers and the complexity of the associated interconnections.

SUMMARY OF THE INVENTION

The present invention provides an illuminated image composed of a plurality of optical fibers. The optical fibers have distal end portions secured to a carrier, and the carrier, in turn, has a surface on which the fiber-optic image is composed and visible. The optical fibers have proximal ends operatively connected to a light source, that is, light from such light source is transmitted from the proximal ends of the optical fibers to the distal end portions so that they are visible on the carrier surface. The fiber-optic image is illuminated by generating digital signals in a desired sequence and transmitting them to the light source. The light source, in turn, has structures therein and structures associated therewith so that the light source emits a selected pattern of different colors over time corresponding to and in response to the digital signals. As a result, the distal end portions of the optical fibers create points of changing color on the visible surface of the carrier, each of the points corresponding to only a single one of the optical fibers through which the light has been transmitted. The result is a fiber-optic illuminated display with an image which appears to change color over time, and yet which has been formed with a reduced number of optical fiber connections and a reduced number of illumination sources.

In one preferred embodiment, the display is carried on flexible planer material, such as the fabric of a clothing item. Power is provided for illuminating the display from a suitable, portable power source, and a programmable microprocessor generates the digital signals to be transmitted to the light source. The light source preferably comprises at least one LED, and the LED emits light at three, respective wavelengths. The brightness of each of the three light emissions is varied by changing the rate at which the digital signals are generated and transmitted to the LED.

The microprocessor used in conjunction with the fiber-optic display varies the pulse rate to each of three substrates defined in the LED, corresponding in one preferred embodiment to red, green, and blue wavelengths, respectively. The varying of the pulse rate to the red, green, and blue substrates varies their respective brightnesses, and varies the resultant color emitted by the LED. The predetermined pattern of varying pulse rates can be programmed to produce any number of desired shifts over time in the resultant color.

The microprocessor addresses a plurality of the above-described LEDs either by using appropriate sequence registers or by other sequential polling techniques. As such, subsets of the LEDs which form the fiber-optic display can be changed through different color sequences at different times in accordance with sequencing between respective LEDs and variation of digital pulses to each of the LEDs.

BRIEF DESCRIPTION OF THE DRAWINGS

For the purposes of illustrating the invention, there is shown in the drawings forms which are presently preferred; it being understood, however, that the invention is not limited to the precise arrangements and instrumentalities shown.

DESCRIPTION OF THE PREFERRED EMBODIMENTS

The following detailed description is of the best presently contemplated modes of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

A fiber-optic illuminated display 21, as shown in FIGS. 5A–5D, is preferably formed on a carrier 23, which may be a flexible material, such as fabric, or a semi-rigid panel placed on an article of clothing or a point-of-purchase display, respectively. The system for controlling and generating fiber-optic display 21 is shown in FIGS. 1–4. In general terms, the control system and associated light sources permit individual optical fibers of the display to emit changing patterns and intensities of colors over time. As such, an eye-catching display is created with a reduced number of optical fibers and associated interconnections.

Figure 1:
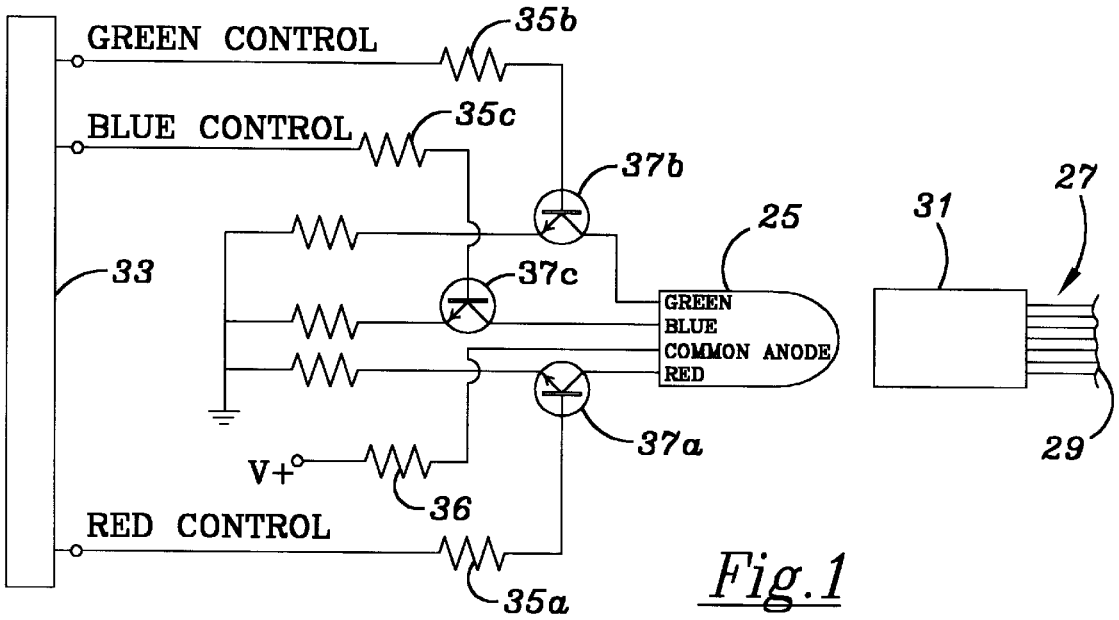
FIG. 1 is a schematic diagram of an optical fiber bundle and associated circuit elements which control color intensity (brightness) and color variation of the individual optical fibers in accordance with the present invention.
Figure 2:
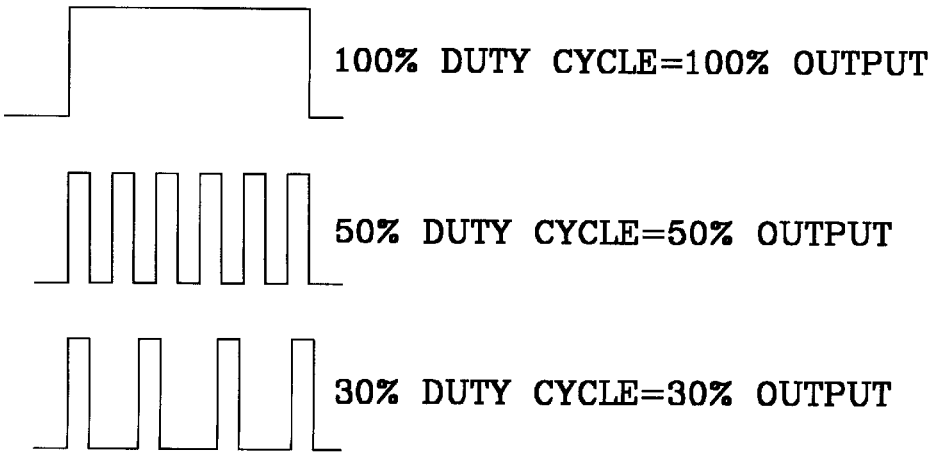
FIG. 2 is a schematic diagram showing variations in the duty cycle associated with the illumination sources of the present invention.

Referring now more particularly to the drawings, and in particular to FIG. 1, a portion of the display and control system of the present invention is shown. An LED 25 is operatively connected to a bundle 27 of optical fibers 29 by a suitable connector 31, as detailed in U.S. Pat. No 4,875,144 [Wainwright], the teachings of which are incorporated by reference. By "operatively connected," it is meant that color emitted from the LED 25 is transmitted through the optical fibers 29 of bundle 27. LED 25 is color changeable and comprises three substrates doped with gallium-based compounds, making such substrates capable of emitting red-, green-, and blue-colored light wavelengths, respectively.

LED 25 is controlled by a suitable control circuit shown schematically at 33 which has respective sub-controllers for the red, green and blue substrates, respectively. In the preferred circuit the sub-controllers turn on and off individually corresponding substrates of the LED to emit any or all of the three basic colors. On each of the respective control lines a brightness limiting resistor 35*a–c* is placed to achieve a color intensity limit of one color substrate against the others. Further, a current limiting resistor 36 is placed on the voltage input line to stabilize the voltage to the common anode of LED 25. Any of a variety of suitable switches, transistors, or relays 37*a–c* can accomplish the aforementioned control functions. Obviously, when only the red substrate is turned on, only red light is emitted, and similarly for the blue and green substrates. Correspondingly, if two or three sections are turned on together, the combination of the three basic colors creates a variety of resultant colors as shown in Table 1, below:

TABLE 1

Production of Resultant Colors

| Red | Green | Blue | Resultant Color |
|---|---|---|---|
| On | Off | Off | Red |
| Off | On | Off | Green |
| Off | Off | On | Blue |
| On | On | Off | Yellow |
| Off | On | On | Cyan |
| On | Off | On | Violet |
| On | On | On | White |

Control circuit 33 transmits digital pulses to each of the substrates of LED 25 at predetermined and desired respective rates. These digital pulse rates are associated with corresponding currents to the substrates which determine the brightnesses of the colored light emitted from each of the substrates. By controlling the digital pulse rate to each substrate of the LED, the brightness of each primary color is changed. Suitable control means discussed hereinafter mix various digital pulse rates in a predetermined pattern to create a corresponding variety of color hues and a corresponding pattern of color variations in the resultant color emitted by LED 25.

In one preferred embodiment, control circuit 33 includes a programmable microcontroller with suitable programming placed in onboard memory to vary the digital pulse rate from approximately 30 to 200 pulses per second. This range of pulse rates, referred to as a duty cycle, is used to adjust the brightnesses of the various substrates as discussed previously. As shown schematically in FIG. 2, if, within this range, digital pulses are emitted 100% of the time, i.e., at 200 pulses per second, the corresponding substrate is considered to be emitting light at 100% output. Likewise, if the digital pulses occur at approximately 50%, or approximately 30%, of the duty cycle, brightness is ½ and ⅓ (approximately) of full brightness, respectively. Significantly, by combining the varying brightness levels of the three LED substrates, many different resultant colors can be emitted from LED 25, potentially as many as 200 million.

Figure 3A:
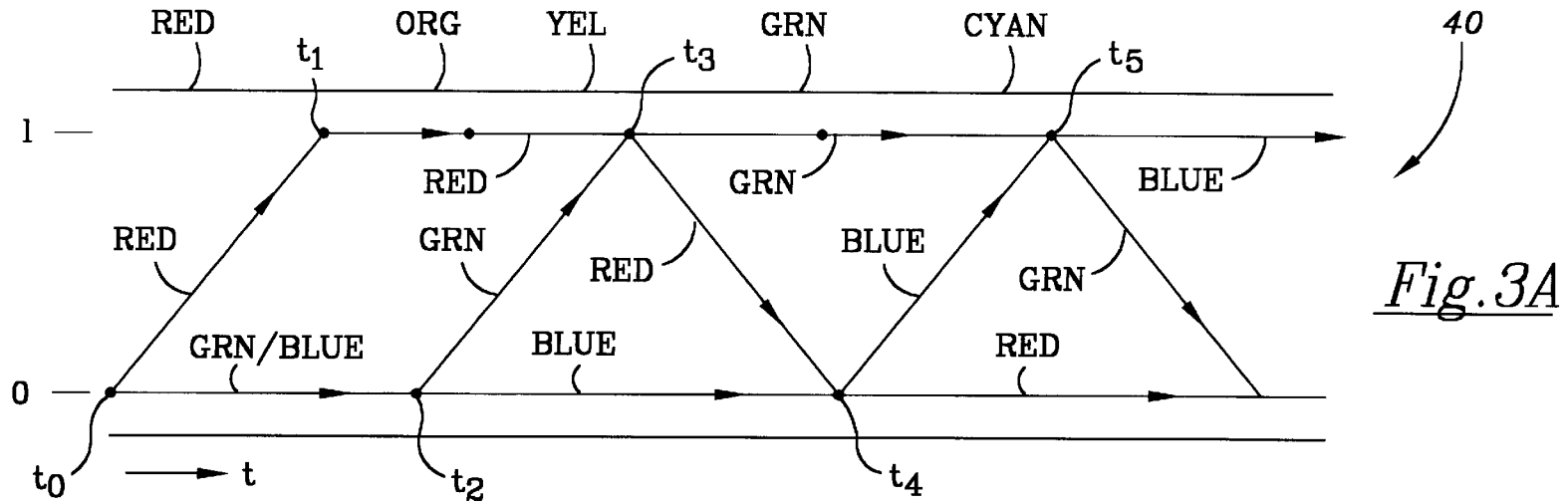
FIGS. 3A and 3B are graphical representation displays of one preferred method of varying composite content of the three component colors of an illumination source according to the present invention.
Figure 3B:
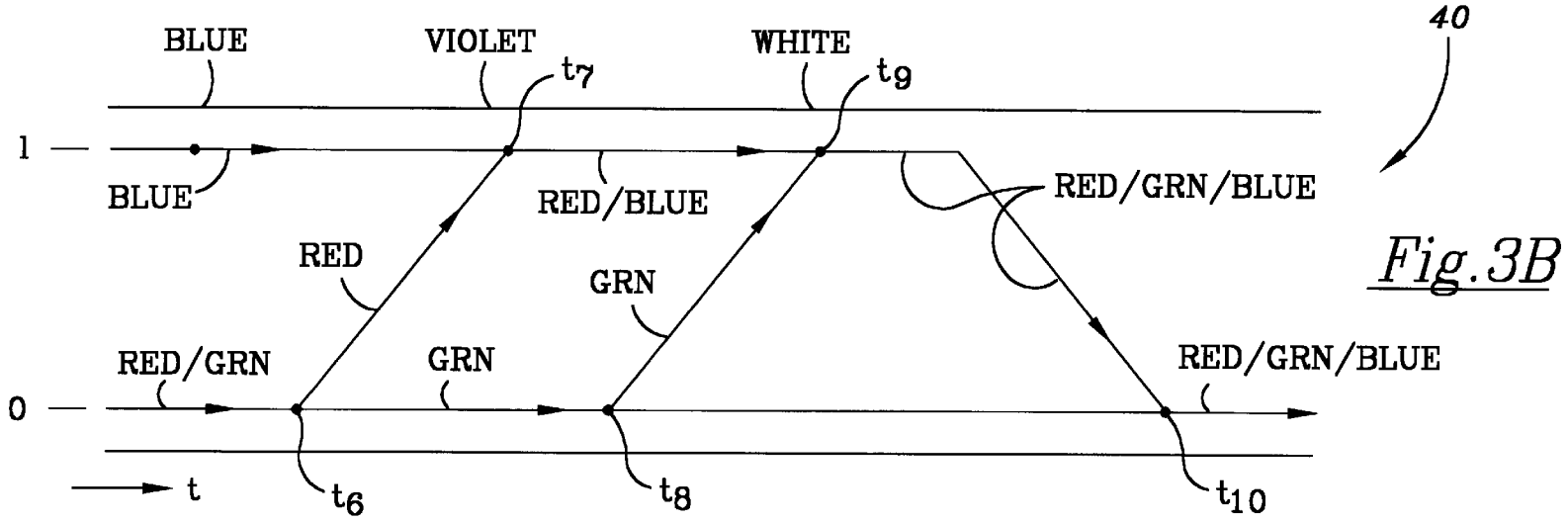
Figure 4:
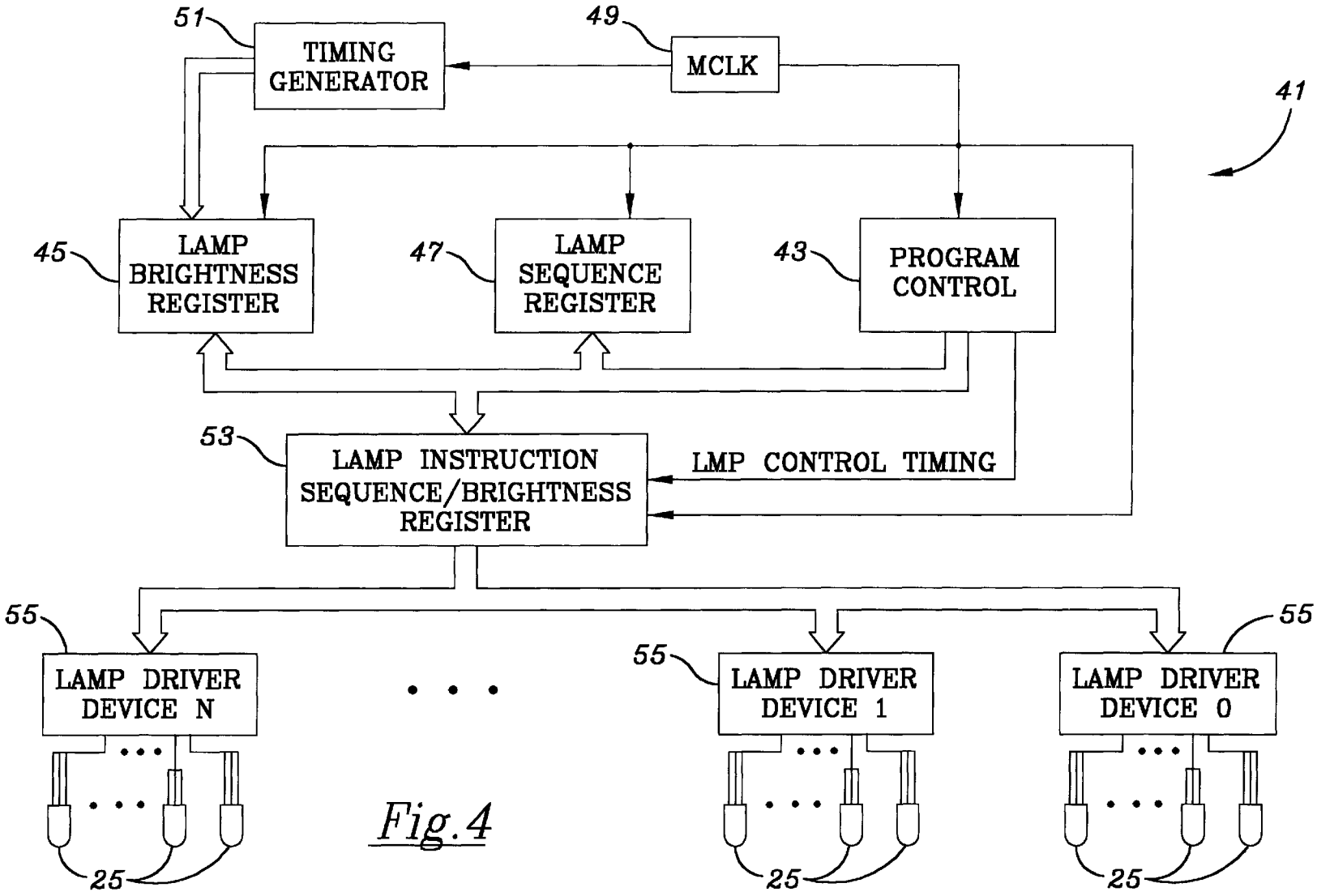
FIG. 4 is a block diagram showing one possible circuit configuration of the present invention in the context of multiple illumination sources.
Figure 5A:
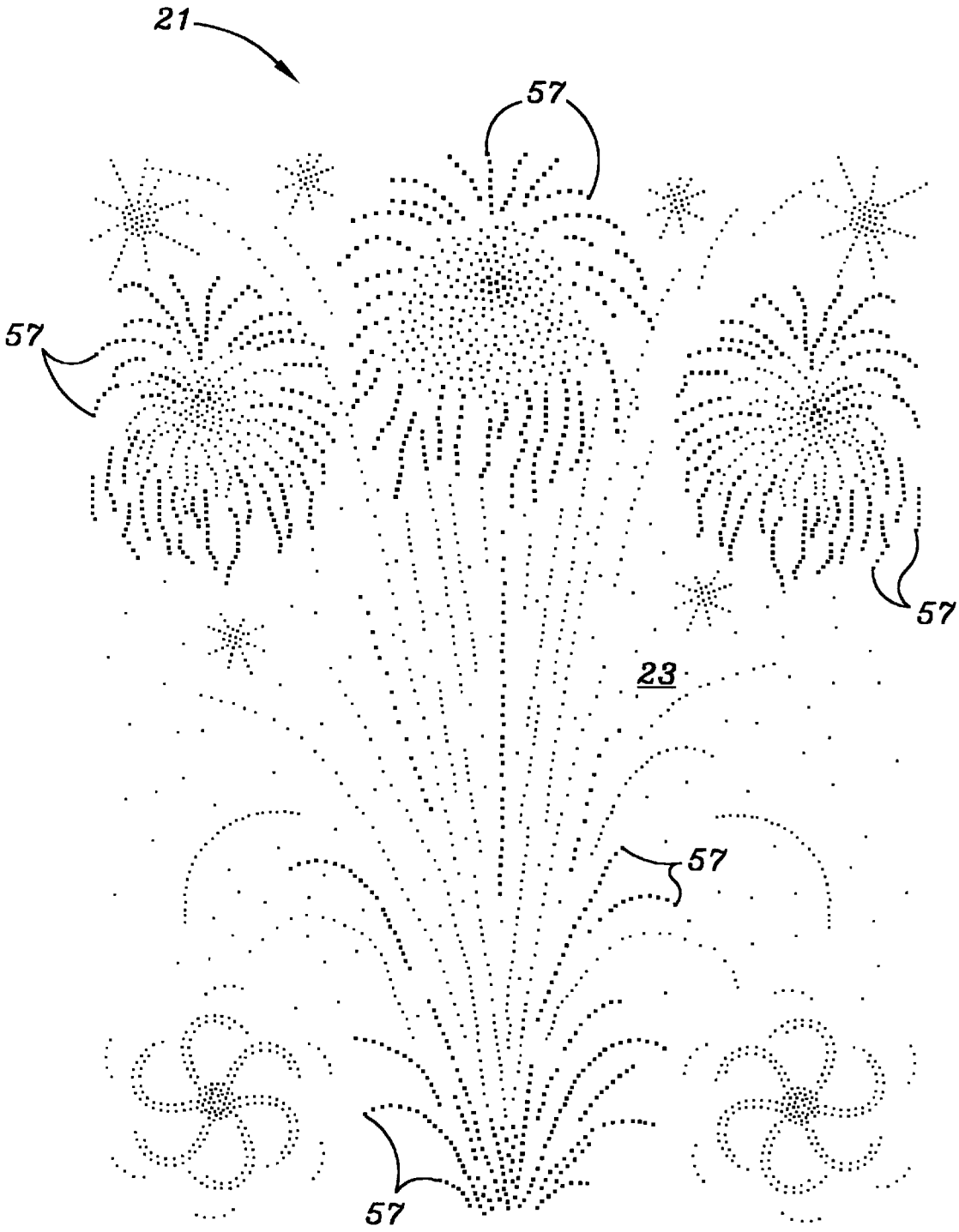
FIGS. 5A–5D show a fiber-optic illuminated display on a flexible material, incorporating the principles of the present invention, and also showing different sequences of illumination.
Figure 5B:
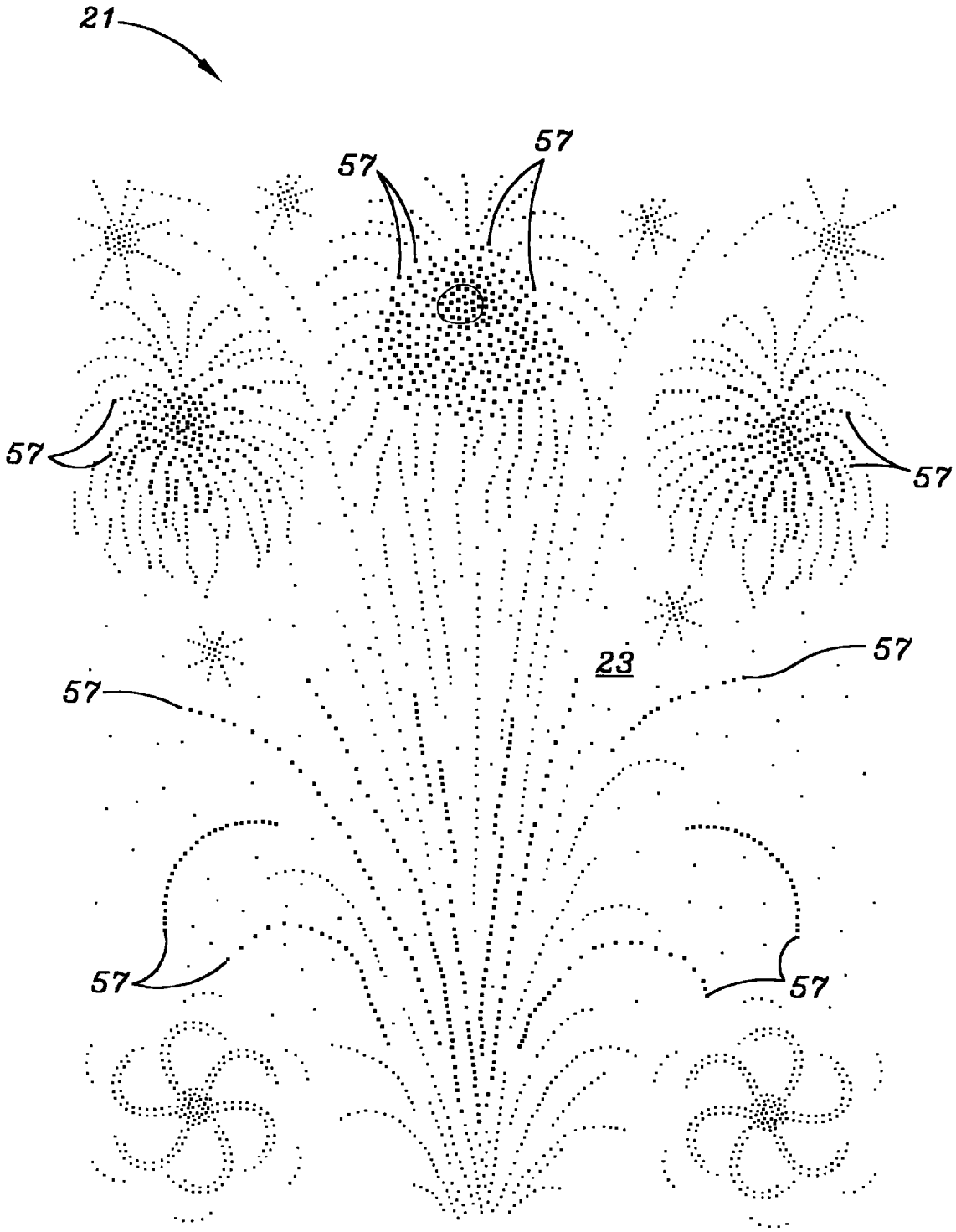
Figure 5C:
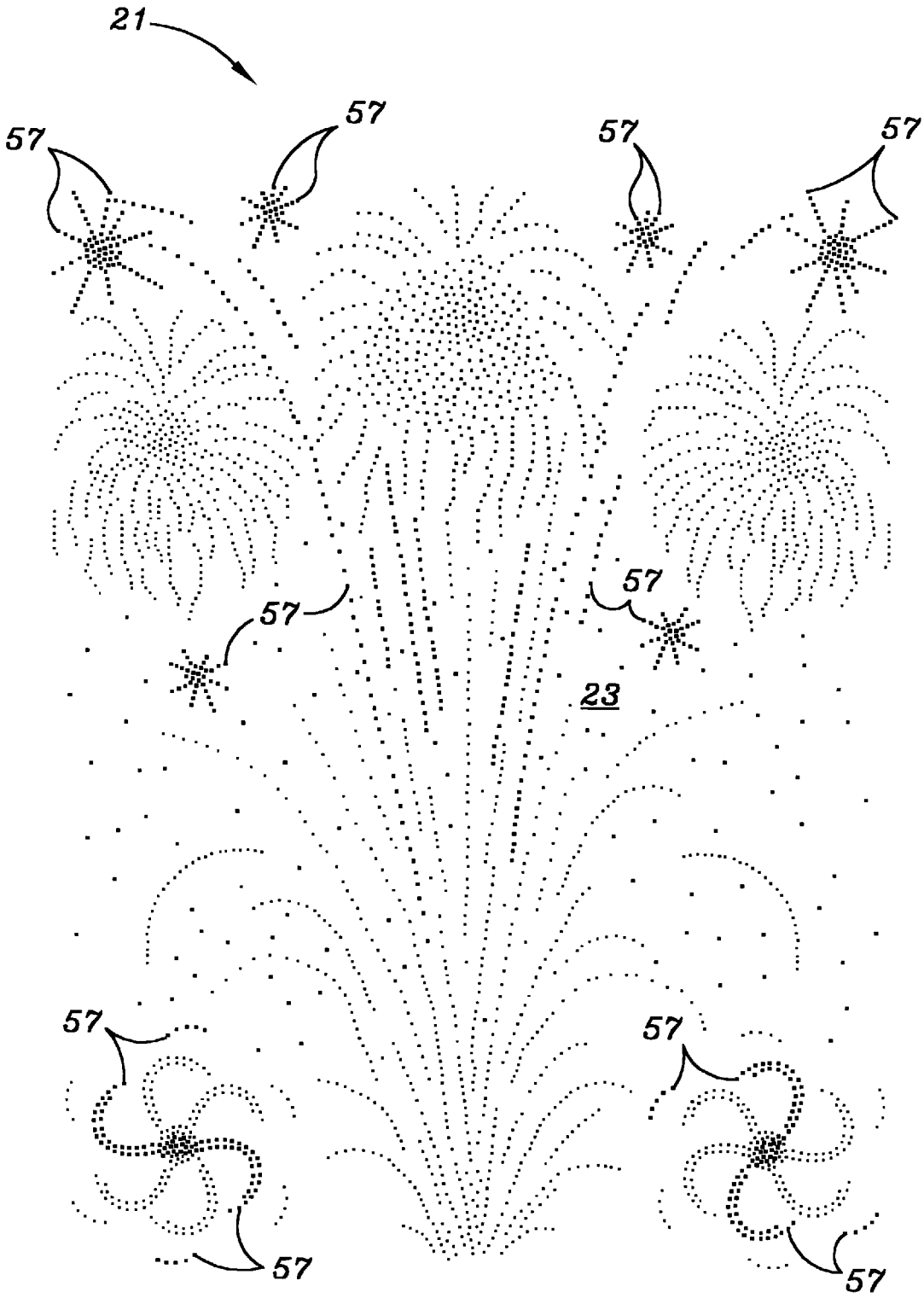
Figure 5D:
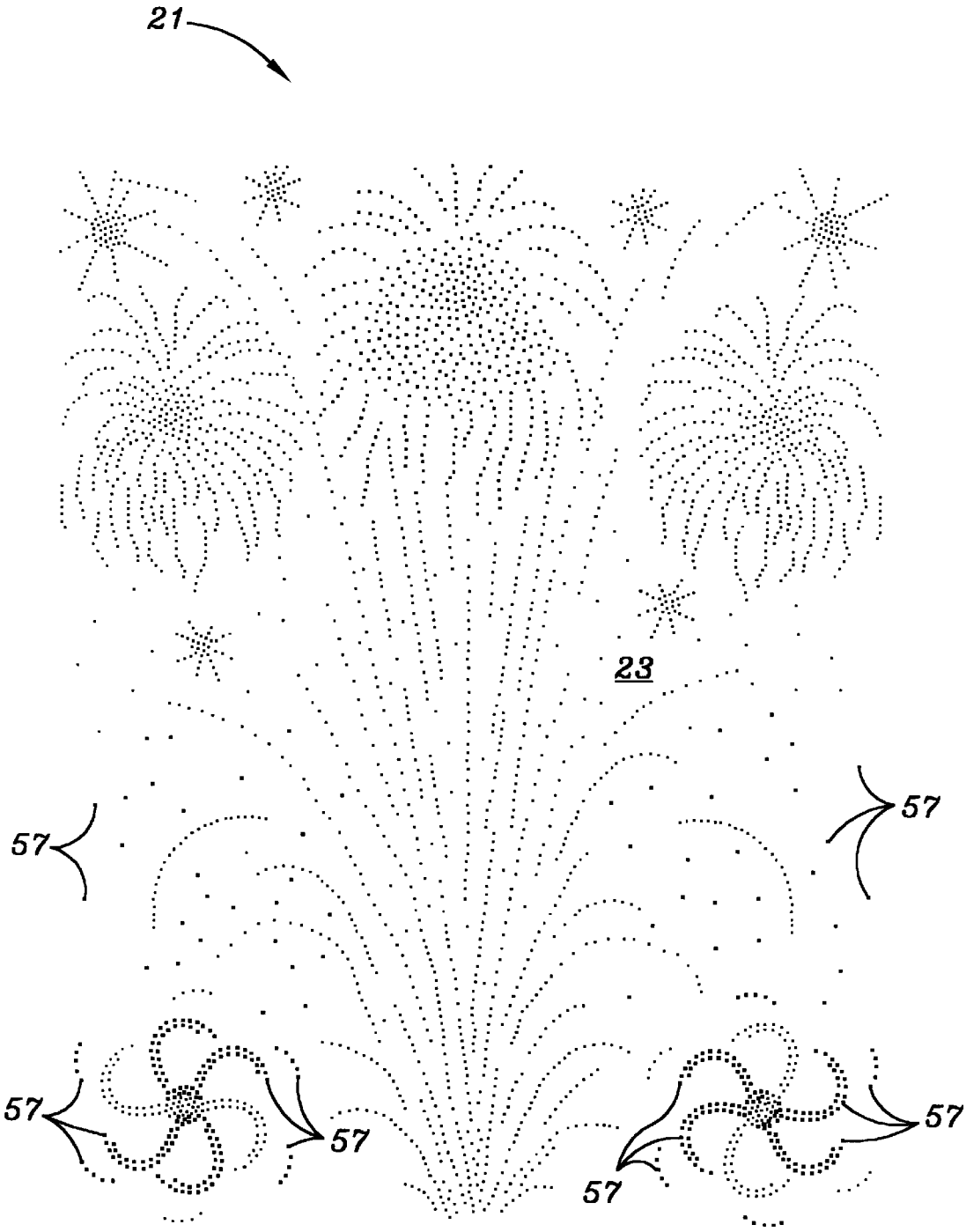

Control circuit 33 further includes suitable instructions to vary the brightnesses of the three substrates in accordance with a pre-determined pattern or sequence. A sample pattern is shown in FIGS. 3A and 3B in which the lower limit of the duty cycle is shown as 0 and the upper limit is shown as 1, time t being shown along the x axis, and the digital pulse rates for each of the three subcontrollers 35 are shown by a series of intersecting paths as described below. The resultant color varies in a corresponding digital color wheel 40 which is depicted in FIGS. 3A and 3B plotted linearly over time.

Beginning at time $t_0$, control circuit 33 increases the brightness of not more than two of the substrates, and preferably the substrate corresponding to the red wavelength, as shown. This first selected substrate is increased to reach its upper limit at a time $t_1$ after $t_0$. Thereafter, at a time $t_2$ after $t_1$, not more than two of the brightnesses are increased, preferably the brightness of the green substrate. The brightness of this second selected substrate achieves its upper limit at a time $t_3$ after $t_2$. Between times $t_2$ and time $t_3$, while the brightness of the green substrate is being increased, the resultant color shifts from red to orange to yellow as shown on the digital color wheel 40.

The changing color cycle continues in a similar manner to produce further colors of digital color wheel 40 as shown in FIGS. 3A and 3B. At least one of the brightnesses at full at time $t_3$ is decreased thereafter to return to its lower limit at a time $t_4$. In this case, red is decreased resulting in a color shift from yellow to green. After time $t_4$, the blue substrate brightness is increased while maintaining green at full brightness. When blue is at full brightness, cyan is produced at time $t_5$ as shown on digital color wheel 40. To obtain blue, the cycling of brightnesses successively decreases green until blue is achieved between times $t_5$ and $t_6$. The cycling of brightnesses continues as shown in FIG. 3B, with red being increased at time to produce a mixture of red and blue (violet) at $t_6$ $t_7$. With blue and red remaining at full brightness, green is increased at $t_8$ to obtain white at time $t_9$. Then all color brightnesses are decreased beginning at a time subsequent to time $t_9$ to indicate a return to no color (LED off state) at time $t_{10}$ as at time $t_0$.

Multiple color hues are generated as brightnesses are varied, but only a subset of those colors have been named in digital color wheel 40, such subset corresponding to those colors produced by combinations of full brightnesses as set out in Table 1. It will be appreciated that the exact pattern of varying brightnesses of the red, blue, and green substrates of LED 25 can be tailored to produce colors of almost infinite number and variety, so as to produce any number of desired, eye-catching effects using the described digital control.

Control circuit 33 for the individual LED 25 shown in FIG. 1 can be associated with a larger program control system which generates fiber optic display 21 shown in FIGS. 5A–5D. One preferred embodiment of such a control system is shown in block diagram at 45 in FIG. 4. In general terms, multiple LEDs 25 are cycled through a desired pattern or sequence of brightnesses as discussed previously, and suitable means are provided for selecting which of the substrates of the LEDs 25 are selected and when such selection occurs. Program Sequence Control system 41 comprises an addressable Lamp Brightness Register 45; an addressable Lamp Sequence Register 47; a Master Clock 49; a Timing Generator 51; and a suitable microprocessor or Program Controller 43. Program Controller 43 selectively addresses the Lamp Brightness and Sequence Registers 46, 47 in accordance with synchronizing clock pulses from Master Clock 49 providing predetermined information concerning the order or sequence, the selection and the brightness of any number of substrates of associated illumination devices, LEDs 25. Program Controller 43 and Timing Generator 51 cooperate to provide a series or pattern of pulse rates (duty cycle) selected brightnesses to the selected LED substrate drivers through the Lamp Instruction Sequence/Brightness Register 53, in synchronous timing afforded by Master Clock 49. The Lamp Instruction Sequence/Brightness Register 53 alternatively passes information related to selected lamp and color and pulse rate (duty cycle) for color selection, brightness of color or color mix and length of "on" time. All information is pre-stored in Program Controller 43 with Lamp Control Timing signals applied to the Lamp Instruction Sequence/Brightness Register 53 to appropriately control the transfer of the alternating information.

Suitable digital-to-analog converters and associated Lamp Drivers 55 capture and decode the digital pulses sequentially transmitted to them and emit pulsed voltages along appropriate pre-determined signal lines to selectively turn on the desired red, green and blue substrates of the LEDs 25, thereby emitting the corresponding selected colors from the LEDs 25 and illuminating the desired ones of the optical fibers 29 with the selected colors. This continues through an entire pre-determined order or sequence of changing illumination (or animation) of patterns of optical fibers implanted on a carrier or panel 23, including color variations, until an illumination sequence is completed and, unless the power source is turned off, the illumination sequence will continue to repeat.

Two LEDs 25 which have been found to be suitable are the Nichia NSTM 515 S –5 mm LED and Nichia NSCM 310 surface mount LED. Upon experimentation, suitable digital pulses for these LEDs have been found to have approximate values of 1.8 volts and 50 mA for the substrate corresponding to red light wavelengths, 3.5 volts and 30 mA for the substrate corresponding to green light wavelengths, and 3.6 volts and 30 mA for the substrate corresponding to blue light wavelengths.

The multiple LEDs 25 of control system 41 are each connected to respective bundles 27 of optical fibers 29 by connectors 31, as shown in FIG. 1. The distal ends of the resulting plurality of optical fibers are then secured at desired locations on a suitable carrier 23, such as the fabric of an article of clothing, to form the desired fiber-optic illuminated display, an example of which is shown in FIGS. 5A–5D. One suitable technique for securing distal ends of optical fibers 29 is disclosed in U.S. Pat. No. 5,738,753 [Schwar, et al.], the teachings of which are incorporated here by reference.

By connecting the distal ends of optical fibers 29 in this manner, multiple points 57 of changing color are created in a desired design on the visible surface 24 of carrier 23. Significantly, each of points 57 corresponds to only a single one of optical fibers 29, by virtue of the fact that changing colors in a digital color wheel pattern have been transmitted by a corresponding LED 25. The result is a pleasing fiber-optic image 21 which appears, to an observer, to change color over time. Such image can be placed at any desired location on a clothing item, wall hanging, point of purchase display and many other applications which skill or fancy may suggest.

The color mutation of the optical fibers 29 can be combined with suitable programming means for dictating the activation sequence of a given set of optical fibers 29, thereby simulating animation. Such simulated animation is shown in FIGS. 5A–5D where the illuminated fibers of optical fibers 29 are shown with bold or larger diameters, and inactive fibers of optical fibers 29 are shown with correspondingly smaller diameters. In particular, a "fireworks" display 21 is created in which simulated animation is used to create the path of travel of the ordnance and its subsequent explosion. The series of figures, FIGS. 5A–5D, sequentially depict the shooting upward of fireworks shells, the explosion of the shells in the air, the changing of colors of the exploded shells while still in the air, and the shooting upward of additional fireworks shells, their explosion and change of color, and the lighting of other fireworks displays on the ground, and the change of color of these displays. The digital color wheel 40, comprised of one or more color changeable LEDs, and associated system controller 41 of the present invention are used to change the colors of the points of light 57 (tips of individual optical fibers) through a pre-determined, sequenced pattern. In this way, the resulting fireworks display 21 also simulates the changing colors frequently observed in real fireworks explosions.

In addition to the advantages apparent from the foregoing description, an attention-getting, fiber-optic, illuminated display is formed by the present invention with a reduced number of optical fibers and a corresponding reduction in the complexity of the associated connections and illumination sources.

A further advantage is that the colors and color intensities emitted by the individual illumination sources through the optical fibers can be selectively varied over time to increase the visual interest of the display.

Another advantage to the invention is that visually interesting displays can be accomplished more economically through the use of fewer materials.

Still another advantage to the invention is that the resulting displays are more lightweight and hence more portable, which is especially important for displays associated with clothing items.

The present invention may be embodied in other specific terms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

We claim:

1. A color changeable fiber-optic illuminated image comprising:

a carrier having a visible surface for the image;

a plurality of optical fibers with distal end portions secured to the visible surface of the carrier creating a number of points for illumination and having proximal ends operatively connected to a light source, so that light from the light source is transmitted to the points for illumination on the surface of the carrier;

means for generating digital signals and transmitting them to the light source at variable respective rates to define corresponding duty cycles, the duty cycles being determinative of a selected pattern of different color variants over time from the light source in response to the digital signals; and points of changing color on the visible surface of the carrier, each of the points of changing color corresponding to only a single one of the optical fibers through which the changing colors have been transmitted, whereby the image appears to change color over time.

2. The illuminated image of claim 1, wherein the carrier comprises a flexible planar material.

3. The illuminated image of claim 2, wherein the carrier comprises an article of clothing.

4. The illuminated image of claim 1, wherein the means for generating digital signals comprises a programmable controller and a signal generator regulated by the controller.

5. The illuminated image of claim 1, wherein the light source comprises at least one LED having an emitting means comprising a plurality of substrates in the LED, each of the substrates having means responsive to the digital signals for emitting light at respective wavelengths to define a resultant color and means responsive to the rate of said generated digital signal for varying the brightness intensity of the light emitted by each of the substrates over time, changing the resulting color and varying the brightness of the resultant light emitted by said LED over time.

6. The illuminated image of claim 1, wherein the digital signals comprise pulses transmitted at rates ranging from about 30 pulses per second to about 200 pulses per second.

7. A method for generating a fiber-optic image of changing color from a plurality of optical fibers in one or more bundles, the distal ends of said optical fibers being secured to a carrier having a visible surface for said image, the method comprising the steps of:

operatively connecting the proximal ends of the optical fibers to at least one LED capable of emitting a plurality of colors;

generating signals for selecting the desired color and transmitting said signals to said at least one LED; and varying the rate at which the generated signals are transmitted to said at least one LED to define corresponding duty cycles for causing the generation of color variants emitted from said at least one LED, the emitted colored light communicating with the distal ends of the fibers to create the fiber-optic image of changing color.

8. The method of claim 7, wherein the step of varying the rate comprises varying the rate of the generated signal to a plurality of different substrates in said at least one LED, each substrate corresponding to a different color, to control the brightness intensity of the emitted colors.

9. A fiber-optic illuminated display for a planar surface, the display comprising:

a plurality of color changeable LEDs, each of said LEDs having a plurality of substrates doped with gallium-based compounds for emitting red-, green-, and blue-colored light, respectively;

means for transmitting digital pulses to each of the substrates at variable respective rates to define corresponding duty cycles for said substrates, the duty cycles of said substrates determining the brightness intensities of the colored light emitted therefrom; the combination of the brightness intensities of the plurality of substrates in the LEDs determining the resultant colors of respective ones of the LEDs;

a plurality of optical fibers with proximal ends arranged into bundles and distal ends attached to said planar surface to define the display thereon;

means for securing the bundles of the optical fibers in operative communication with corresponding ones of the LEDs to transmit the emitted colors from the LEDs to the bundles of the optical fibers;

programmable means for sequentially selecting corresponding one of the LEDs to be illuminated and for varying the duty cycles in a pattern over time to vary the corresponding brightness intensities of the plurality of substrates of said selected LEDs, thereby changing the respective resultant colors emitted by said LEDs, whereby the changing of the colors emitted by the LEDs changes the colors of the associated optical fibers in accordance with the sequential pattern to create a color-mutable, fiber-optic illuminated display.

10. The illuminated display of claim 9, wherein the programmable means varies the rate of pulses in the range of between 30 and 200 pulses per second, and the pulses have approximate values of 1.8 volts and 50 mA for the substrate corresponding to red light wavelengths, 3.5 volts and 30 mA for the substrate corresponding to green light wavelengths, and 3.6 volts and 30 mA for the substrate corresponding to blue light wavelengths.

11. The illuminated display of claim 9, wherein the duty cycles range from 100 percent to 30 percent with corresponding brightness intensities ranging from 100 percent to 30 percent, respectively.

12. The illuminated display of claim 9, wherein the programmable means includes suitable instructions to vary the brightness intensities of the light emitted from the plurality of substrates of respective ones of the LEDs, the brightness intensities being varied in accordance with the pattern of: (1) increasing not more than two of the brightness intensities at a time $t_0$; (2) increasing not more than two of the brightnesses at a time $t_1$ after $t_0$ to achieve a desired upper limit therefor at a time $t_3$; and (3) decreasing at least one of the brightnesses after time t3.

* * * * *